US010881185B2

(12) United States Patent
Denece

(10) Patent No.: US 10,881,185 B2
(45) Date of Patent: Jan. 5, 2021

(54) PACKAGING FOR PACKAGING A PRODUCT SUCH AS A COSMETIC COMPOSITION

(71) Applicant: AXILONE PLASTIQUE, Auray (FR)

(72) Inventor: Jean-Paul Denece, Baden (FR)

(73) Assignee: AXILONE PLASTIQUE, Auray (FR)

( * ) Notice: Subject to any disclaimer, the term of this patent is extended or adjusted under 35 U.S.C. 154(b) by 56 days.

(21) Appl. No.: 16/318,926

(22) PCT Filed: Jul. 13, 2017

(86) PCT No.: PCT/FR2017/051928
§ 371 (c)(1),
(2) Date: Jan. 18, 2019

(87) PCT Pub. No.: WO2018/015639
PCT Pub. Date: Jan. 25, 2018

(65) Prior Publication Data

US 2019/0274410 A1 Sep. 12, 2019

(30) Foreign Application Priority Data

Jul. 19, 2016 (FR) ..... 16 56883

(51) Int. Cl.
*A45D 40/22* (2006.01)
*A45D 34/00* (2006.01)

(52) U.S. Cl.
CPC ..... *A45D 40/222* (2013.01); *A45D 34/00* (2013.01); *A45D 40/221* (2013.01);
(Continued)

(58) Field of Classification Search
CPC .... A45D 40/222; A45D 34/00; A45D 40/221; A45D 2040/223; A45D 2040/226; A45D 2200/051; A45D 2200/056; B65D 45/322
(Continued)

(56) References Cited

U.S. PATENT DOCUMENTS 5,353,818 A * 10/1994 Suzuki ..... A45C 13/008 132/294
5,896,866 A * 4/1999 Quennessen ..... A45C 13/008 132/293

(Continued)

FOREIGN PATENT DOCUMENTS

| | | |
|---|---|---|
| EP | 0 836 817 A1 | 4/1998 |
| EP | 2 607 258 A1 | 6/2013 |
| FR | 2 984 696 A1 | 6/2013 |

OTHER PUBLICATIONS

International Search Report, dated Oct. 10, 2017, from corresponding PCT application No. PCT/FR2017/051928.

*Primary Examiner* — Chun Hoi Cheung
(74) *Attorney, Agent, or Firm* — Nixon & Vanderhye

(57) ABSTRACT

Packaging for packaging a product, such as a cosmetic composition Packaging (100) for packaging a product comprising a container (1) provided with an opening (10), a lid (3) able to move between a closed position in which it closes the opening (10) of the container (1) and an open position, and a storage unit (2). The storage unit (2) comprises: —a bowl (21) delimiting a reservoir (20) accepting the product and able to move in a vertical axial direction (Z), —an elastically deformable pressure-difference compensating system (22) forming a sealed connection between the bowl (21) and the lid (3). The storage unit (2) delimits, in combination with the lid (3) in the closed position, a sealed compartment (8) exhibiting a variable volume.

12 Claims, 4 Drawing Sheets

(52) U.S. Cl.
CPC .. *A45D 2040/223* (2013.01); *A45D 2040/226* (2013.01); *A45D 2200/051* (2013.01); *A45D 2200/056* (2013.01)

(58) Field of Classification Search
USPC ..... 206/581; 220/830; 132/293, 294, 303, 132/300, 315
See application file for complete search history.

(56) References Cited

U.S. PATENT DOCUMENTS

| | | | | | |
|---|---|---|---|---|---|
| 5,988,185 | A * | 11/1999 | Gueret | A45D 40/22 | 132/294 |
| 6,164,293 | A * | 12/2000 | Gueret | A45D 40/22 | 132/294 |
| 6,345,627 | B1 * | 2/2002 | Petit | A45D 33/006 | 132/293 |
| 7,334,685 | B2 * | 2/2008 | Mathiez | A45D 40/22 | 206/581 |
| 7,481,229 | B2 * | 1/2009 | Habatjou | A45D 33/006 | 132/293 |
| 8,261,934 | B2 * | 9/2012 | Salciarini | A45D 40/22 | 206/581 |
| 9,961,980 | B2 * | 5/2018 | Greenfield | B65D 81/05 | |
| 10,219,603 | B2 * | 3/2019 | Tatin | A45D 40/0068 | |
| 2013/0161345 | A1 | 6/2013 | Tatin | | |
| 2014/0231304 | A1 * | 8/2014 | Lee | A45D 33/008 | 206/581 |
| 2015/0122697 | A1 * | 5/2015 | Shen | A45D 33/00 | 206/581 |
| 2018/0235347 | A1 * | 8/2018 | Young | A45D 40/0068 | |

* cited by examiner

PACKAGING FOR PACKAGING A PRODUCT SUCH AS A COSMETIC COMPOSITION

BACKGROUND OF THE INVENTION

The invention relates to the packaging of products, such as cosmetic compositions.

It more particularly concerns a package for packaging a product such as a cosmetic composition, comprising a container provided with an opening at the top and defining a housing, a lid that is movable between a closed position where it closes the opening of the container and an open position, and a storage unit.

Such packages, also called "receptacles", are used primarily for packaging products containing volatile components, particularly for cosmetic, pharmaceutical, and other similar compositions.

The products concerned must be able to be kept under optimum fluidtight conditions in order to prevent the air present in the package, and loaded with moisture from the product, from escaping and being replaced by air from the drier outside environment. Because if there is a leak, this exchange would lead to restoring the hydrometric equilibrium of the product and therefore a loss of weight of the product over time.

Variations in atmospheric pressure due to changes in weather or to traveling, for example during transport in an aircraft hold, generate differences in air pressure between the interior and the exterior of the package, which greatly stresses the sealing of such packages.

Packages of the aforementioned type are already known, where the lid is either screwed onto the container or hinged to the container. However, none of the known packages of this type can completely satisfy the above requirements. The seal is usually provided by gaskets exerting forces in the radial direction, which often requires significant screwing torque in the case of a screwed lid or significant closing force in the case of a hinged lid. Manipulation of these packages is therefore not comfortable for a user, both for closing and opening the lid.

Also known are packages of the aforementioned type, as presented in patent FR 2984696, where the lid compensates for differences in air pressure between the interior and exterior of the package. Although these packages are very satisfactory, it is still possible to improve such packages to reduce their size and therefore their bulk.

SUMMARY OF THE INVENTION

The invention aims in particular to provide a package of the aforementioned type which offers comfortable opening and closing of the lid in conditions that are satisfactory for the user.

Another object of the invention is to provide a package of the aforementioned type which can guarantee a seal over a wide range of temperatures, typically from −10° C. to +50° C., with little loss in weight of the product it contains.

Another object of the invention is to provide such a package that is simpler to design and less expensive to manufacture.

For this purpose, the invention proposes a package for packaging a product, as defined above.

According to the invention, the storage unit comprises a vessel housed at least partly in the housing of the container and defining a reservoir suitable for receiving the product, said vessel being movable along a vertical axial direction between a rest position, a raised position, and a lowered position, and a pressure difference compensation system that is elastically deformable and suitable for forming a sealed connection between the vessel and the lid.

According to the invention, the storage unit defines, in combination with the lid in the closed position and for a constant amount of cosmetic product, a sealed compartment having a first volume when the vessel is in the rest position, a second volume less than the first volume when the vessel is in the raised position, and a third volume greater than the first volume when the vessel is in the lowered position.

As a result, the storage unit and the lid in the closed position form a fluidtight separation between the air contained inside and outside the compartment. In addition, the deformable nature of the pressure difference compensation system allows the vessel to move according to the differences between the pressures on each side of the compartment, and therefore to increase or decrease the volume of said compartment while the same amount of cosmetic product is contained in the vessel at time t, all while maintaining the fluidtight separation between the exterior and interior of the compartment.

In the closed position of the lid, the movement of the vessel makes it possible to satisfy Boyle's law which states that the product of the pressure and volume of a perfect gas at constant temperature is constant, in the compartment forming a sealed enclosure. A flexible connection is thus obtained which allows variations in the volume of the compartment, reducing the pressure exerted on the sealing area.

The package according to the invention is particularly compact, and of a simple design allowing a low cost and a reduced number of parts.

For the purposes of the invention, the term "package" is understood to mean different types of packages or receptacles, such as bottles, jars, tubes, cases. In most cases, the package comprises a flat bottom to which is attached a cylindrical wall having a chosen geometric outline, for example circular, oval, elliptical, polygonal, etc. Such a package is open at the top to form the opening which receives the lid.

In the invention, in the closed position of the lid, the vessel of the storage unit is in the rest position when the pressure inside the compartment is equal to the pressure outside the package, is in a raised position when the pressure inside the compartment is greater than the pressure outside the package, and is in a lowered position when the pressure inside the compartment is less than the pressure outside the package.

According to another characteristic of the invention, the package further comprises at least one spring means bearing on the container and urging the pressure difference compensation system in a vertical axial direction such that the pressure difference compensation system comes into sealing engagement against the lid when said lid is in the closed position.

The at least one spring means of the package of the invention ensures a constant and reliable pressure on the pressure difference compensation system forming the sealing area between the container and the lid.

This spring means is thus able to absorb deformations and to oppose the internal pressure within the compartment.

In a preferred embodiment of the invention, this at least one spring means comprises an at least partial wave spring acting by compression and arranged perpendicularly to the vertical axial direction.

This spring may be made of metal or plastic.

To contribute to a better seal, it is provided that the pressure difference compensation system comprises a generally flexible peripheral ring surrounded by a generally rigid annular edge.

The pressure compensation system is preferably formed by overmolding two materials comprising a first generally flexible material for the peripheral ring and a second generally rigid material for the annular edge.

To contribute to a better seal, it is advantageously provided that the peripheral ring comprises a gasket bearing sealingly against the lid.

In the invention, the peripheral ring comprises a deformable membrane, said membrane comprising an outer periphery integral with the annular edge and an inner periphery integral with the vessel. The deformable membrane is carried by the storage unit.

Thus, when the lid reaches the closed position, the lid causes displacement of the annular edge towards the bottom of the housing, ensuring compression of the spring means which contributes to the fluidtight seal. Conversely, when the lid is then brought to an open position, the spring means facilitates its opening by moving the annular edge upwards.

According to another characteristic of the invention, the housing of the container is in communication with the exterior by means of at least one vent arranged through the container. This contributes to bringing the housing to the outside pressure, in other words atmospheric pressure.

The lid of the invention may be completely independent of the container. It is preferred, however, that this lid be connected to the container by a hinge. The lid then cannot be lost.

In the invention, the hinge may comprise a first hinge portion integral to a ring attached to the container and a second hinge portion integral to the lid.

According to yet another characteristic of the invention, the storage unit is provided with a removable cover sheet suitable for closing the reservoir.

BRIEF DESCRIPTION OF THE DRAWINGS

The figures of the drawings are now briefly described.

DETAILED DESCRIPTION OF THE PREFERRED EMBODIMENTS

Below is a detailed description of the invention, accompanied with examples and with reference to the drawings.

Figure 1:
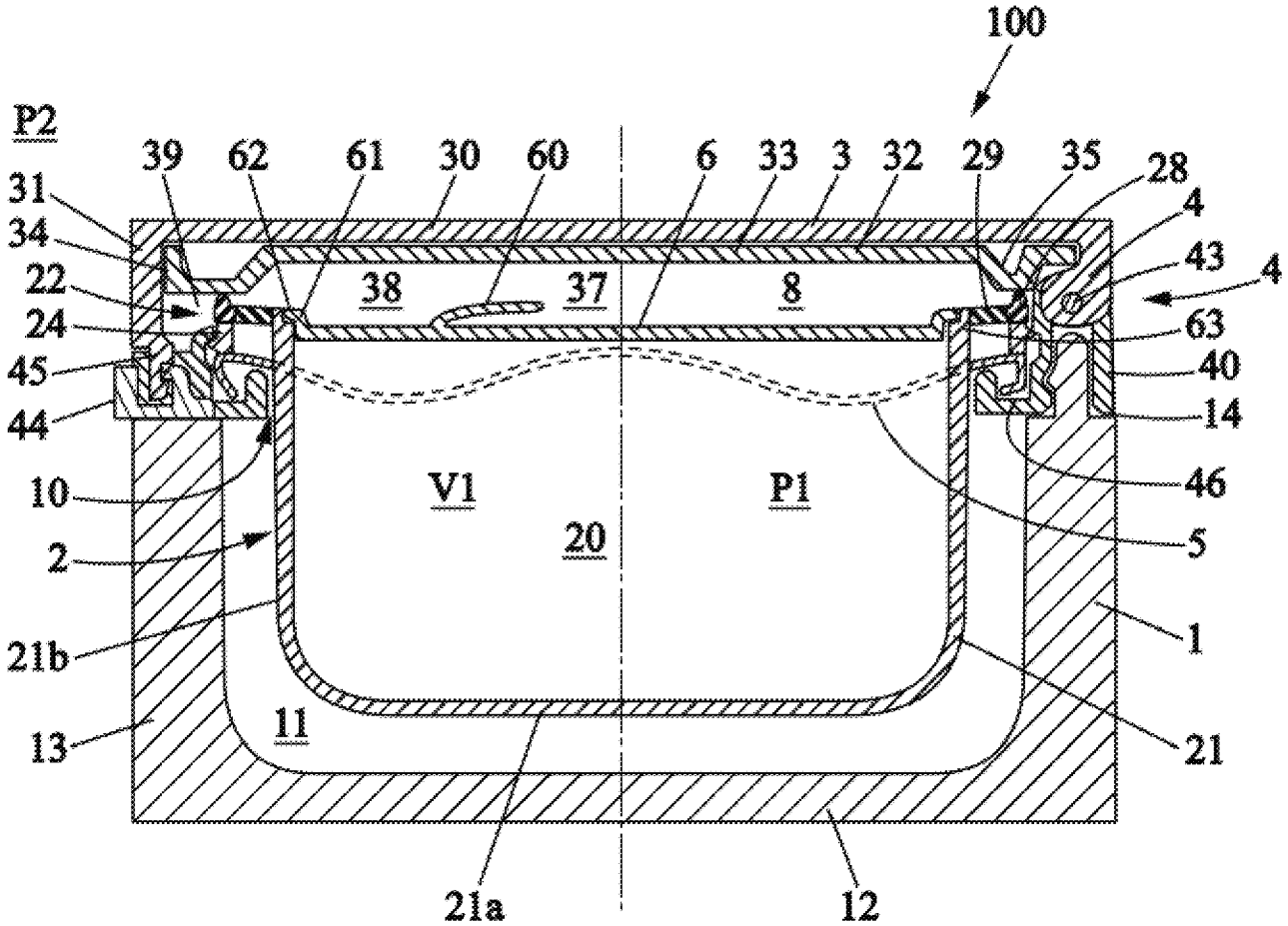
FIG. 1 is a schematic sectional view of a package according to the invention with the lid in the closed position, the vessel of the storage unit being represented in a rest position.

We first refer to FIG. 1, which shows a package 100 intended for packaging a product, in particular a product with volatile components. For example, this may be a cream or a similar type of cosmetic composition. The package 100 may comprise a container 1, for example a pot or tube, a storage unit 2, and a lid 3. In the example shown in FIG. 1, the lid 3 is hinged to the container 1 by a hinge 4 which will be described in detail below.

The container 1 may comprise a generally flat bottom wall 12. The bottom wall 12 has a chosen geometric outline, for example circular, oval, elliptical, polygonal, etc. The bottom wall 12 is surmounted by a side wall 13. The side wall 13 defines an open face with an opening 10 in the upper portion. In the example shown, the container 1 is hollow and forms a housing 11. The housing 11 is suitable for internally receiving at least a portion of the storage unit 2. The storage unit 2 forms a reservoir 20 for receiving the product to be packaged and stored.

More particularly, the housing 11 is suitable for internally receiving at least a portion of a vessel 21 that is part of the storage unit 2. The vessel 21 is intended to receive the product to be packaged and stored.

The storage unit 2 may further comprise a pressure difference compensation system 22 which forms an edge or annular seating around the opening 10 of the container 1. The pressure difference compensation system 22 is integral with the vessel 21 and is suitable for attachment, for example by clipping, to the container 1. The pressure difference compensation system 22 thus makes it possible to connect the vessel 21 to the container 1. In addition, the pressure difference compensation system 22 engages with the lid 3 as described below.

The lid 3 is movable between a closed position where it closes the opening 10 of the container 1 and an open position where it allows access to the opening 10 of the container 1. The lid 3 comprises a bottom wall 30, alternatively flat or domed, which constitutes the bottom of the lid 3. The bottom wall 30 is attached to a side wall 31 which has substantially the same contours as the side wall 13 of the container 1. The side wall 21*b* defines an open face with an opening 31*a* in the lower portion. The bottom wall 30, the opening 31*a*, and the side wall 31 define a hollow interior space 37. The bottom wall 30 and the side wall 31 form a sealed wall, for example airtight.

In the example shown, the lid 3 internally receives an insert 32 in the form of a plate. The insert 32 comprises a substantially flat central region 33, for example bearing against the bottom wall 30 of the lid 3. The insert 32 further comprises a peripheral region 34 having a shoulder 35. The shoulder 35 is adapted to bear against the storage unit 2 to ensure a sealed connection between the lid 3 and the storage unit 2. This sealed connection ensures airtightness. When the lid 3 is in the closed position, the sealed connection between the lid 3 and the storage unit 2 divides the internal space 37 of the lid 3 into two regions; an inner region 38 and an outer region 39. The outer region 39 is between the side wall 31 of the lid 3 and the sealed connection formed between the shoulder 35 and the storage unit 2. The inner region 38 is between the central region 33 of the insert 32 and the sealed connection formed between the shoulder 35 and the storage unit 2. When the lid 3 is in the closed position, the inner region 38 and the reservoir 20 are in communication and form a single sealed compartment 8.

More particularly, the shoulder 35 is adapted to bear against the pressure difference compensation system 22 of the storage unit 2. The sealed connection between the lid 3 and the pressure difference compensation system 22 ensures the fluidtightness of the compartment 8.

The container 1 and the lid 3 are connected to each other by a hinged connection. The hinged connection is, for example, a hinge 4. The hinge 4 comprises a first hinge portion 41 integral to a ring 40 attached to the container 1. The hinge 4 further comprises a second hinge portion 42 integral to the lid 3. These two hinge portions 41, 42 are interconnected by a pivot 43.

Opposite the hinge 4, the ring 40 comprises a latch 44 engaging with a hook 45 extending from the lid 3. The latch 44 is movable in a longitudinal direction, perpendicular to a vertical axial direction Z, the vertical direction Z being a direction generally perpendicular to the plane defined by the lid 3 when said lid 3 is in the closed position. The latch 44 is movable between a locking position where it prevents the lid 3 from pivoting and an unlocking position where it allows the lid 3 to pivot about the axis of the hinge 4 in order to permit the movement of said lid 3 from the closed position to the open position. When a user wishes to open the lid 3, he or she simply needs to press the latch 44, which allows the lid 3 to pivot about the axis of the hinge 4.

Also, the lid 3 is not necessarily connected to the container 1 by a hinge 4. The lid 3 could be connected to the container 1 by one or more magnets. The lower face of the side wall 31 of the lid may comprise the magnet or magnets and the upper face of the ring 40, which is opposite the lower face of the side wall 31 when the lid 3 is in the closed position, may comprise one or more pieces of ferromagnetic material. The magnets exert an attractive force on the pieces of ferromagnetic material, which holds the lid 3 in the closed position. The attractive force is weak enough to allow the user to move the lid 3 to the open position. Alternatively, the lower face of the side wall 31 may comprise the piece or pieces of ferromagnetic material and the upper face of the ring 40 may comprise the magnet or magnets.

Alternatively, it could be a completely independent lid 3 that can be screwed on and off the container 1. The inner face of the side wall 31 of the lid 3 may comprise a thread and the inner face of the ring 40 may be tapped to receive the thread of the lid 3.

The storage unit 2 comprises the vessel 21 and the pressure difference compensation system 22.

The vessel 21 may comprise a bottom wall 21*a*, alternatively flat or domed. The bottom wall 21*a* has a chosen geometric outline, for example circular, oval, elliptical, polygonal, etc. The bottom wall 21*a* is surmounted by a side wall 21*b*. The side wall 21*b* defines an open face with an opening 21*c* at the top. The bottom wall 21*a* and side wall 21*b* form a sealed enclosure. In the example shown, the vessel 21 is hollow and forms the reservoir 20.

The container 1 and the vessel 21 may be made of different materials. The container 1 is, for example, made of polymethyl methacrylate (abbreviated PMMA) or polycarbonate (abbreviated PC). The vessel 21 is, for example, made of another material compatible with the product received in the reservoir 20, such as polypropylene. The vessel 21 thus makes it possible to form an internal lining in cases where the constituent material of the container 1 is not compatible with the type of product to be contained. It may be conceivable to use the storage unit 2 as a refill.

The vessel 21 is mounted so as to be movable within the housing 11 of the container. More particularly, the vessel 21 is movable in translation along the vertical axial direction Z. The vessel 21 is movable between a rest position and a lowered position. In the rest position, the bottom wall 21*a* of the vessel 21 is at a distance from the bottom wall 12 of the container 1, and the opening 21*c* of the vessel 21 is at a distance from the lid 3. The distance between the bottom wall 21*a* of the vessel 21 and the bottom wall 12 of the container 1 is, for example, identical to the distance between the opening 21*c* of the vessel 21 and the lid 3. In the lowered position, the bottom wall 21*a* of the vessel 21 is closer to the bottom wall 12 of the container 1 and the opening 21*c* of the vessel 21 is further away from the lid 3, relative to the rest position. The distance between the bottom wall 21*a* of the vessel 21 and the bottom wall 12 of the container 1 is smaller when the vessel 21 is in the lowered position than when the vessel 21 is in the rest position, and the distance between the opening 21*c* of the vessel 21 and the lid 3 is larger when the vessel 21 is in the lowered position than when the vessel 21 is in the rest position.

In addition, the vessel 21 is movable between a rest position and a raised position. In the raised position, the bottom wall 21*a* of the vessel 21 is further away from the bottom wall 12 of the container 1 and the opening 21*c* of the vessel 21 is closer to the lid 3, than in the rest position. The distance between the bottom wall 21*a* of the vessel 21 and the bottom wall 12 of the container 1 is greater when the vessel 21 is in the raised position than when the vessel 21 is in the rest position, and the distance between the opening 21*c* of the vessel 21 and the lid 3 is smaller when the vessel 21 is in the raised position than when the vessel 21 is in the rest position.

The pressure difference compensation system 22 is adapted to ensure the fluidtightness of the compartment 8, and therefore of the product that the reservoir 20 contains, when the lid 3 is in a closed position, as is the case in FIG. 1.

The pressure difference compensation system 22 comprises a peripheral ring 23 and an annular edge 24. The annular edge 24 is connected to the peripheral ring 23.

The annular edge 24 may be rigid. In the example shown, the annular edge 24 has a generally L-shaped cross-section. The annular edge 24 comprises a vertical flange 25 extending between a first end 25*a* integral to the peripheral ring 23 and a free second end 25*b*. The annular edge 24 further comprises a rib 26 projecting radially from the vertical flange 25 towards the container 1. The rib 26 is adapted to snap into a groove 27 formed on the ring 40. The function of the rib 26 and groove 27 is to hold the annular edge 24 in a fixed position relative to the container 1.

The ring 40 comprises a channel 46 extending radially inward into the container 1. The channel 46 has a cavity of generally U-shaped cross-section with a bottom 46*a*, an inner flange 46*b*, and an outer flange 46*c* which is higher than the inner flange 46*b* and comprises the groove 27.

The peripheral ring 23 may be flexible in order to facilitate its deformation according to the pressure differences between an internal pressure P1 prevailing within the compartment 8 and an external pressure P2 prevailing outside the package 100, in other words the atmospheric pressure.

The peripheral ring 23 comprises a gasket 28 made of flexible material, such as flexible thermoplastic. The gasket 28 may be annular. The gasket 28 is adapted to be compressed in sealing engagement against the lid 3 by the annular edge 24, for example against the bottom wall 30 of the lid 3, in order to seal the compartment 8. More particularly, the gasket 28 is adapted to be compressed by the annular edge 24 in sealing engagement against the insert 32, for example against the shoulder 35 of the insert 32, in order to seal the compartment 8.

The peripheral ring 23 further comprises a deformable membrane 29. The membrane 29 is made of flexible material, such as flexible thermoplastic. The membrane 29 comprises an outer periphery 29*a* connected to the annular edge 24 and an inner periphery 29*b* connected to the vessel 21. The gasket 28 is integral to the membrane 29. Movement of the membrane 29 is unconstrained in order to allow displacement of the vessel 21 between the raised, rest, and lowered positions without impacting the fluidtightness of the compartment 8.

The pressure difference compensation system 22 may be created by injection overmolding using two materials, a first generally flexible material for the gasket 28 and membrane 29 and a second generally rigid material for the annular edge 24. The first material is preferably chosen from the elastomers, such as thermoplastic elastomers. The second material is preferably chosen from the thermoplastic polymers, such as polypropylene.

The pressure difference compensation system 22 is subjected to the action of at least one elastic means, a wave spring 5 with partial waves in the example. The spring 5 may be a single-turn, multi-turn, or nested wave spring. Alternatively, the spring 5 is a full wave spring. The spring 5 has a variable number of waves depending on the amplitude and frequency values of said wave(s) of the spring 5. The spring 5 is made of metal, for example spring steel. Alternatively, the spring 5 is made of plastic. Wave springs have the advantage of being inexpensive and compact.

The spring 5 comprises a succession of waves 51 of which a part bears against the ring 40 of the container 1. More particularly, part of the waves 51 of the wave spring 5 bears against the bottom 46*a* of the channel 46 of the ring 40. Thus, the spring 5 is wedged in the channel 46, and thus in the container 1. The spring 5 urges the annular edge 24 of the pressure difference compensation system 22 in the vertical axial direction Z. More particularly, the gasket 28 is urged in the vertical axial direction Z by the spring 5, via the annular edge 24. The spring 5 acts in compression and is arranged perpendicularly to the vertical axial direction Z. The wave spring 5 allows exerting suitable pressure that is regularly distributed over the annular edge 24, and thus on the gasket 28.

The storage unit 2 further comprises a removable cover sheet 6 intended to close the opening 21*c* of the vessel 21. The cover sheet 6 may comprise a tongue 60 for grasping, to allow easy removal and/or placement of the cover sheet 6 by the user. To limit translational movement of the cover sheet 6, a first retaining shoulder 62 is provided on the peripheral edge 61 of said cover sheet 6, suitable for bearing against a second retaining shoulder 63 formed on the upper end of the side wall 21*b* of the vessel 21, under the action of gravitational force.

The invention is not limited to a particular form of spring means. Instead of using a wave spring, other means may be used, for example a compression coil spring, an elastic leaf spring, or one or more elastically compressible elastomer pads. In the case of one or more elastically compressible elastomer pads, this may be either a continuous ring-shaped pad arranged, for example by gluing, on the bottom 46*a* of the channel 46 of the ring 40, or elements spaced apart.

The housing 11 of the container 1 holds a variable volume of air. Indeed, the movable vessel 21 occupies more or less space inside said housing 11 depending on its position. The housing 11 is in communication with the exterior by at least one vent 14 arranged near the hinge 4. Thus, air can flow between the housing 11 and outside the package 100, and the housing 11 is always at the external pressure P2, in other words ambient atmospheric pressure.

The sealed connection between the lid 3 and the storage unit 2, in the closed position of the lid 3, is provided by the gasket 28 held in compression on the shoulder 35 of the insert 32 by the spring 5. The first region 38 of the lid 3 defines, in combination with the reservoir 20 of the storage unit 2, the compartment 8 of variable volume.

The deformable membrane 29 allows the vessel 21 to be moved between the rest position, the raised position, and the lowered position. The lid 3 is stationary when in the closed position. Thus, the volume of the compartment 8 varies with the position of the vessel 21. More particularly, the reservoir 20 defined by the bottom wall 21*a*, the side wall 21*b*, and the opening 21*c* of the vessel 21, has a constant volume, and the first region 38 defined by the central region 33 of the insert 32, the sealed connection, and the opening 21*c* of the vessel 21, has a variable volume.

When the internal pressure P1 inside the compartment 8 is equal to the external pressure P2 outside the package 100, the vessel 21 is in the rest position, as can be seen in FIG. 1, and the compartment 8 has a first volume V1.

Figure 2:
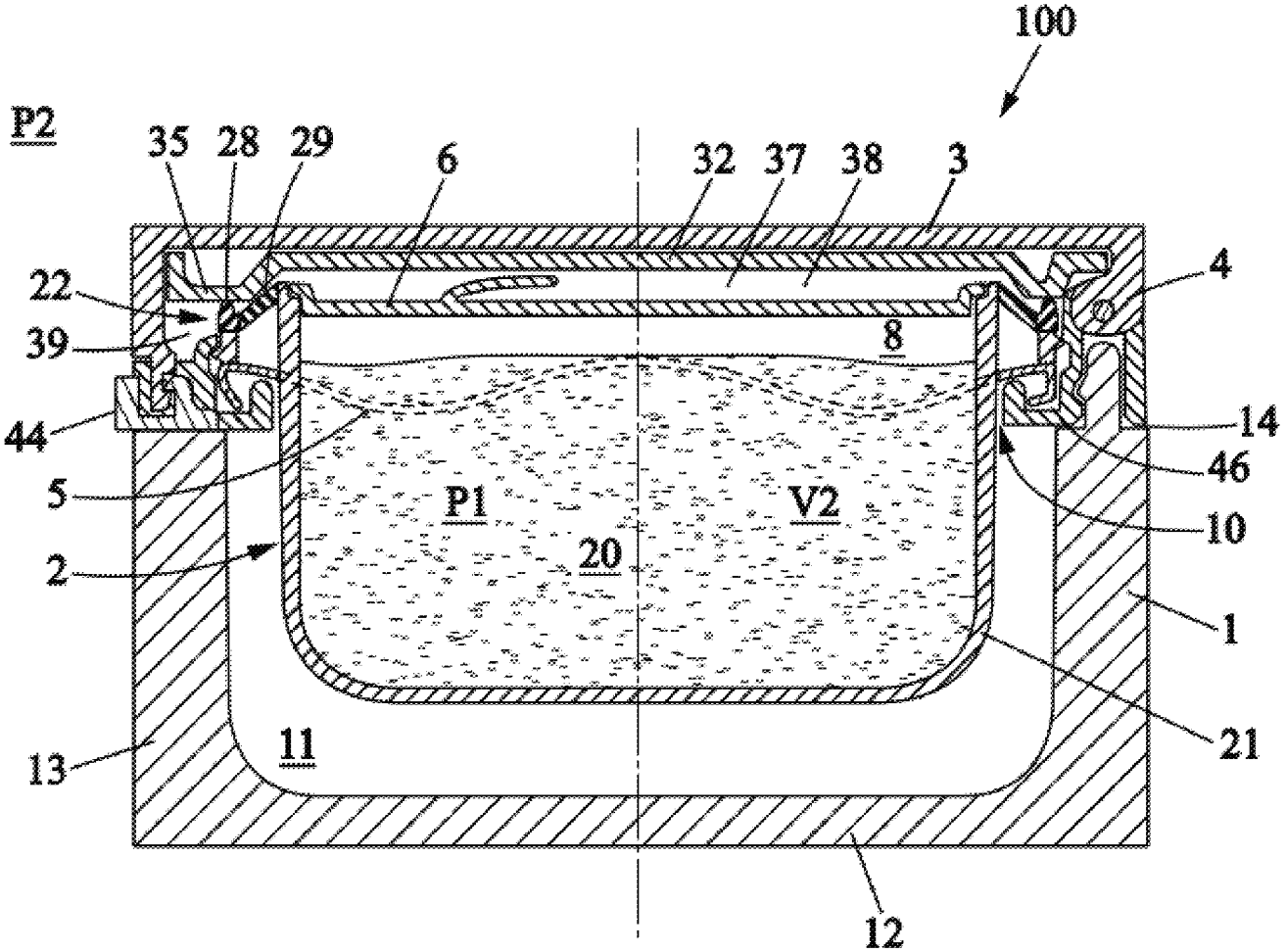
FIG. 2 is a schematic sectional view of the package of FIG. 1, the vessel of the storage unit being represented in a raised position.

When the internal pressure P1 inside the compartment 8 is less than the external pressure P2 outside the package 100, the vessel 21 is in the raised position, as can be seen in FIG. 2, and the compartment 8 has a second volume V2. The second volume V2 is smaller than the first volume V1 in order to satisfy Boyle's law. As a result, the moment when a leak would occur at the gasket 28 is postponed by displacement of the vessel 21.

Figure 3:
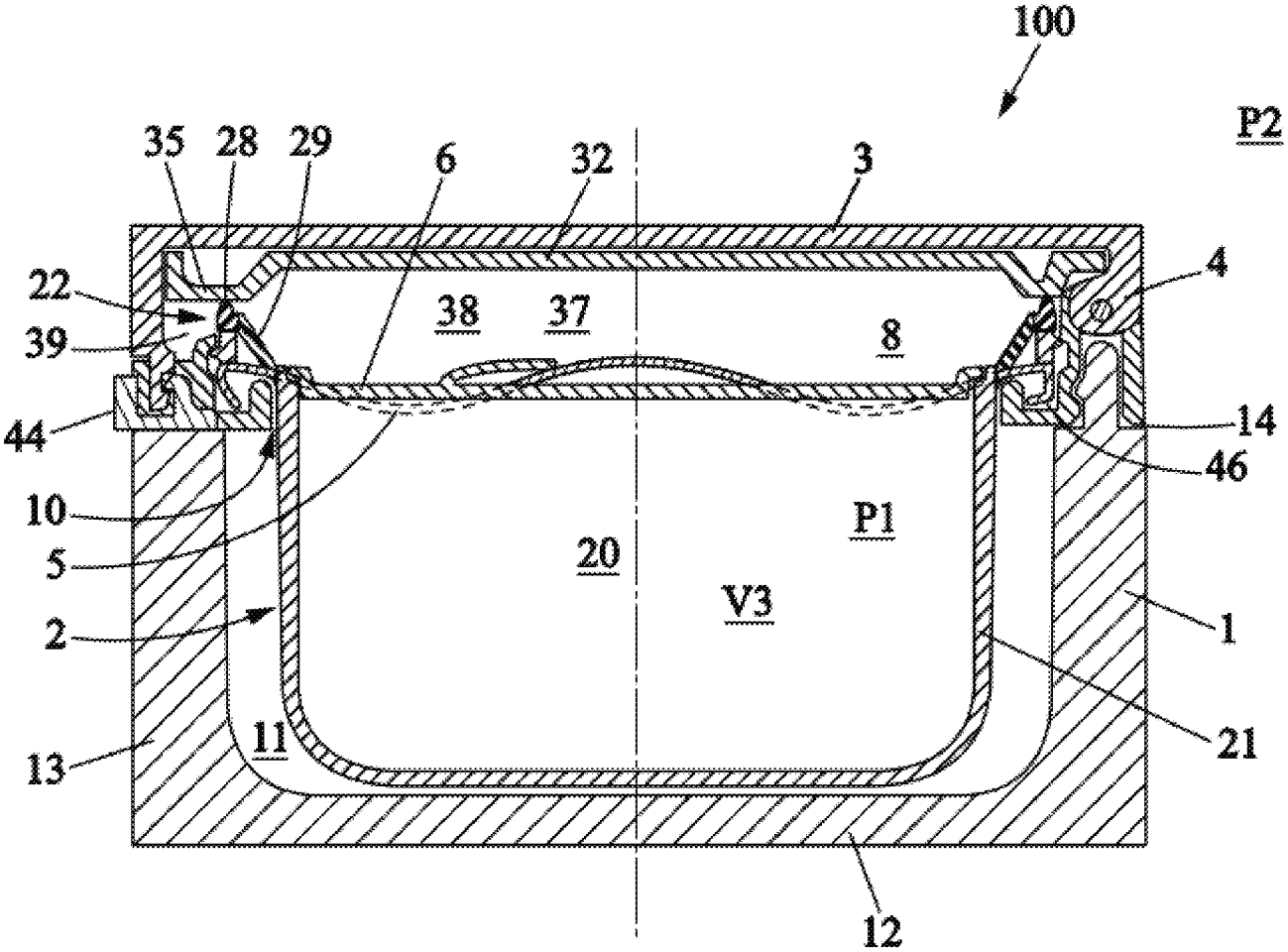
FIG. 3 is a schematic sectional view of the package of FIG. 1, the vessel of the storage unit being represented in a lowered position.
Figure 4:
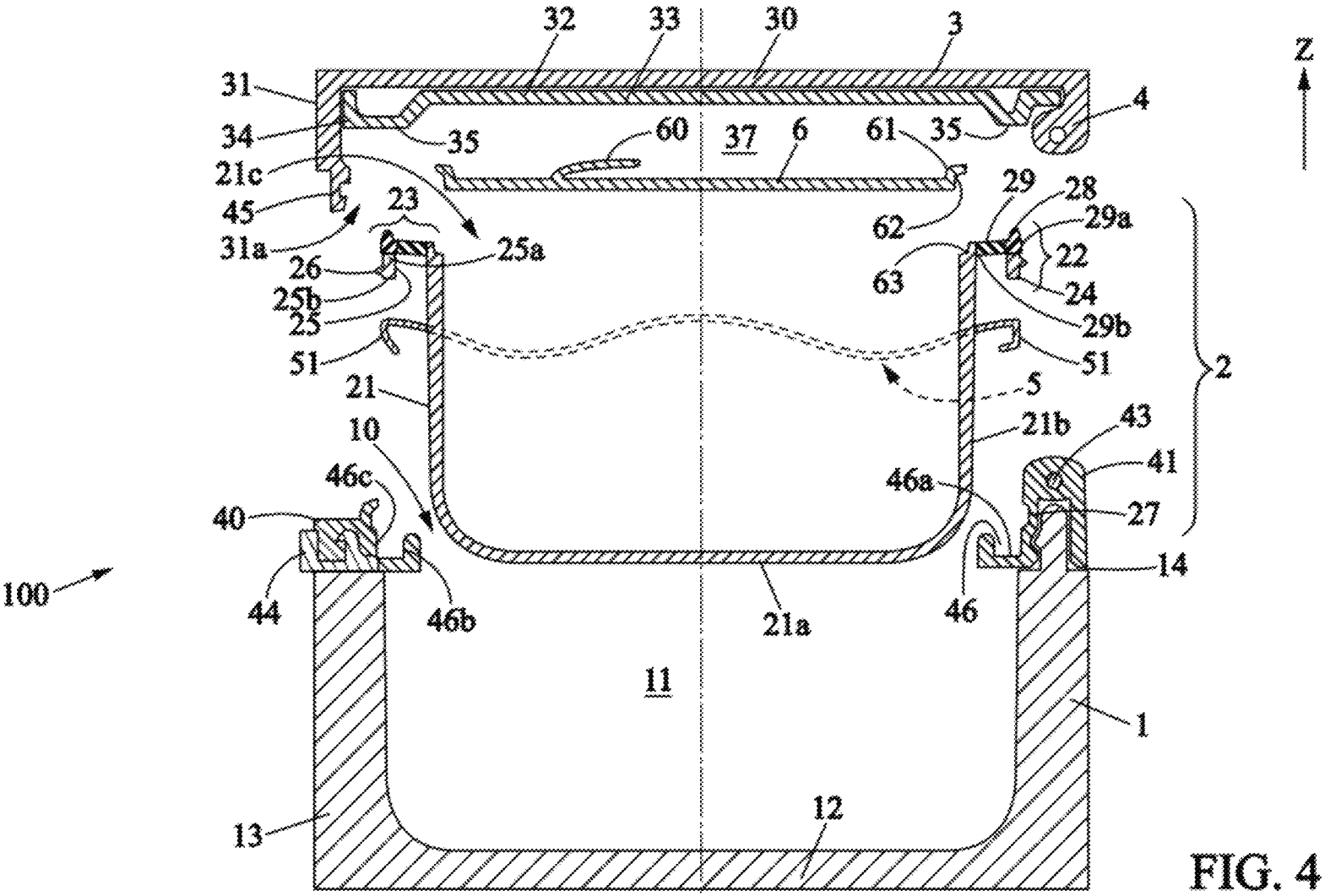
FIG. 4 is an exploded view of the elements of the package of FIG. 1.

When the internal pressure P1 inside the compartment 8 is greater than the external pressure P2 outside the package 100, for example when the package 100 is placed in the hold of an aircraft in flight, the vessel 21 is in the lowered position, as shown in FIG. 3, and the compartment 8 has a third volume V3. The third volume V3 is greater than the first volume V1 and second volume V2 in order to satisfy Boyle's law. As a result, the moment when a leak would occur at the gasket 28 is postponed by displacement of the vessel 21.

The manufacture of the package 100 and more particularly the packaging of the product in said packages 100 is carried out in factories where a factory atmospheric pressure prevails. The factory atmospheric pressure is, for example, close to atmospheric pressure at sea level. Thus, when the packaging of products in the packages 100 is finished, the internal pressure P1 inside the compartment 8 of each of the packages 100 is equal to the factory atmospheric pressure. The packages 100 packaged in this manner are then sent to storage centers before being individually sold to users. An interval of several weeks to several months may exist between the packaging of a package 100 at the factory and the first time it is opened by the user. It is generally within this interval of time that the seal of the package 100 is the most heavily stressed (transport in an aircraft hold, frequent variations in atmospheric conditions related to alternating high and low pressure areas, etc.).

It is particularly important, when the user opens the package 100 for the first time, that the user finds the product unchanged from when it was packaged. For this reason, it is necessary to control the internal pressure P1 of the compartment 8 during this time interval in order to minimize the risk of leakage from said compartment 8. Indeed, a large leak due to an abrupt change in the external pressure P2 or repetitive leaks due to frequent changes in the external pressure P2 (alternating high and low pressure areas) depletes the water content of the product and therefore a loss of weight over time. It is the control of the fluidtightness of the compartment 8 during this time interval that is the particular aim of the invention.

When the lid 3 is in the open position, the connection between the lid 3 and the storage unit 2 is broken, and the internal pressure P1 is equal to the external pressure P2, the vessel 21 is in the rest position. Thus, the storage unit 2 has a pleasant visual appearance for the user, requiring no additional parts to hide the pressure difference compensation system 22.

Since the seal occurs in the vertical axial direction Z, there is less resistance to opening and closing than in the case where sealing means which function in the radial direction are used, as is the case in existing packages.

The invention finds particular application in the fluidtight packaging of products containing volatile substances, such as cosmetic creams or pharmaceutical products, although this list is not limiting.

The invention claimed is:

1. A package (100) for packaging a product, comprising:

a container (1) provided with an opening (10) and defining a housing (11);

a lid (3) that is movable between an open position and a closed position, the lid closing the opening (10) of the container (2), when in the closed position; and a storage unit (2), the storage unit comprising:

a vessel (21), housed at least partly in the housing (11) of the container (1) and defining a reservoir (20) suitable for receiving the product, said vessel being movable along a vertical axial direction (Z) between a rest position, a raised position, and a lowered position, and a pressure difference compensation system (22) that is elastically deformable and suitable for forming a sealed connection between the vessel (21) and the lid (3), wherein the storage unit (2) defines, in combination with the lid (3) in the closed position and for a constant amount of the product, a sealed compartment (8) having a first volume (V1) when the vessel (21) is in the rest position, a second volume (V2) less than the first volume (V1) when the vessel (21) is in the raised position, and a third volume (V3) greater than the first volume (V1) when the vessel (21) is in the lowered position, and wherein, in the closed position of the lid (3), the vessel (21) of the storage unit (2) is in the rest position when a pressure (P1) inside the compartment (8) is equal to a pressure (P2) outside the package (100), is in the raised position when the pressure (P1) inside the compartment is less than the pressure (P2) outside the package, and is in the lowered position when the pressure (P1) inside the compartment is greater than the pressure (P2) outside the package.

2. The package (100) according to claim 1, further comprising:

at least one spring means bearing on the container (1) and urging the pressure difference compensation system (22) in the vertical axial direction (Z) such that the pressure difference compensation system comes into sealing engagement against the lid (3) when said lid is in the closed position.

3. The package (100) according to claim 2, wherein the spring means is an at least partial wave spring (5) acting by compression and arranged perpendicularly to the vertical axial direction (Z).

4. The package (100) according to claim 1, wherein the pressure difference compensation system (22) comprises a generally flexible peripheral ring (23) surrounded by a generally rigid annular edge (24).

5. The package (100) according to claim 4, wherein the pressure compensation system (22) is formed by overmolding two materials comprising a first generally flexible material for the peripheral ring (23) and a second generally rigid material for the annular edge (24).

6. The package (100) according to claim 4, wherein the peripheral ring (23) comprises a gasket (28) bearing sealingly against the lid (3).

7. The package (100) according to claim 4, wherein the peripheral ring (23) comprises a deformable membrane (29), said membrane comprising an outer periphery (29*a*) integral with the annular edge (24) and an inner periphery (29*b*) integral with the vessel (21).

8. The package (100) according to claim 1, wherein the housing (11) of the container (1) is in communication with the exterior by means of at least one vent (14) arranged through the container.

9. The package (100) according to claim 1, wherein the lid (3) is connected to the container (1) by a hinge (4).

10. The package (100) according to claim 9, wherein the hinge (4) comprises a first hinge portion (41), integral to a ring (40) attached to the container (1), and a second hinge portion (42) integral to the lid (3).

11. The package (100) according to claim 1, wherein the storage unit (2) is provided with a removable cover sheet (6) configured for closing the reservoir (20).

12. The package (100) according to claim 1, wherein the product is a cosmetic composition.

* * * * *